US006895954B2

(12) United States Patent
Swierczyna et al.

(10) Patent No.: US 6,895,954 B2
(45) Date of Patent: May 24, 2005

(54) SCRUBBER VENTILATION SYSTEM

(75) Inventors: Richard T. Swierczyna, Frankfort, IL (US); Joseph N. Knapp, Addison, IL (US); Donald P. Fisher, Danville, CA (US); David Rudzinski, Aurora, IL (US)

(73) Assignee: Gas Research Institute, Des Plaines, IL (US)

( * ) Notice: Subject to any disclaimer, the term of this patent is extended or adjusted under 35 U.S.C. 154(b) by 0 days.

(21) Appl. No.: 10/201,840

(22) Filed: Jul. 24, 2002

(65) Prior Publication Data

US 2002/0179084 A1 Dec. 5, 2002

Related U.S. Application Data

(63) Continuation-in-part of application No. 09/708,746, filed on Nov. 7, 2000, now abandoned.

(51) Int. Cl.[7] ..... B01D 47/66; B01D 47/02; F47F 7/06

(52) U.S. Cl. ..... 126/299 E; 126/299 R; 55/DIG. 36; 96/341; 95/226

(58) Field of Search ..... 126/299 R, 299 E, 126/299 D; 55/DIG. 36, 527, 525, 526, 355; 96/333, 337, 361, 362, 363, 364, 357, 279, 341; 95/226

(56) References Cited

U.S. PATENT DOCUMENTS

| | | | | | |
|---|---|---|---|---|---|
| 1,964,794 | A | | 7/1934 | Gilbert | |
| 1,994,766 | A | * | 3/1935 | Heglar | 96/279 |
| 2,000,706 | A | * | 5/1935 | Lowther | 96/335 |
| 2,015,174 | A | * | 9/1935 | Anglemyer | 96/334 |
| 2,021,215 | A | * | 11/1935 | Winslow | 96/339 |
| 2,397,525 | A | * | 4/1946 | Bennett | 96/336 |
| 2,405,494 | A | * | 8/1946 | Dupuy | 96/340 |
| 2,409,558 | A | * | 10/1946 | Gunn | 95/200 |
| 2,583,252 | A | * | 1/1952 | Carraway | 261/26 |
| 2,596,121 | A | * | 5/1952 | Brixius | 96/335 |
| 2,770,320 | A | * | 11/1956 | Dreznes | 96/341 |
| 2,943,920 | A | * | 7/1960 | Hoover | 422/170 |
| 2,966,958 | A | * | 1/1961 | Sexton | 96/263 |
| 2,987,138 | A | * | 6/1961 | Walton | 96/379 |
| 3,260,189 | A | * | 7/1966 | Jensen | 126/299 D |
| 3,282,033 | A | * | 11/1966 | Seppanian | 96/279 |
| 3,381,453 | A | * | 5/1968 | Dills | 96/136 |
| 3,481,115 | A | * | 12/1969 | Brandt | 96/237 |
| 3,519,947 | A | * | 7/1970 | Sexton | 330/260 |
| 3,537,239 | A | * | 11/1970 | Dunmire | 96/228 |
| 3,642,259 | A | | 2/1972 | Bowden | |
| 3,695,005 | A | * | 10/1972 | Yuzawa | 96/110 |
| 3,756,580 | A | | 9/1973 | Dunn | |
| 3,844,748 | A | * | 10/1974 | Lanier | 96/342 |
| 4,116,647 | A | * | 9/1978 | Garner | 96/275 |
| 4,290,784 | A | * | 9/1981 | Rawicki | 95/226 |
| 4,351,652 | A | * | 9/1982 | Wisting | 96/265 |

(Continued)

FOREIGN PATENT DOCUMENTS

| | | | |
|---|---|---|---|
| DE | 3644179 | * | 7/1988 |
| EP | 0 194 343 | * | 9/1986 |

(Continued)

*Primary Examiner*—Carl D. Price
(74) *Attorney, Agent, or Firm*—Mark E. Fejer

(57) ABSTRACT

A ventilation system for removing cooking effluents and combustion products from an exhaust of a cooking appliance. The ventilation system includes a ventilation hood having an air inlet and an exhaust gas outlet disposed over the cooking appliance, a water bath disposed in the ventilation hood between the air inlet and the exhaust outlet, and an effluent removal assembly disposed above the water bath. The cooking effluents in contact with the effluent removal assembly are transferred to the surrounding water, and the clean airflow may be recirculated. Grease particles are also transferred to the surrounding water.

26 Claims, 2 Drawing Sheets

U.S. PATENT DOCUMENTS

| | | | | | |
|---|---|---|---|---|---|
| 4,407,266 | A | * | 10/1983 | Molitor | 126/299 D |
| 4,432,777 | A | * | 2/1984 | Postma | 95/151 |
| 4,859,405 | A | * | 8/1989 | Squarer et al. | 376/299 |
| 5,078,759 | A | | 1/1992 | Kira | |
| 5,141,538 | A | | 8/1992 | Derington et al. | |
| 5,358,540 | A | | 10/1994 | Tsan-Yun et al. | |
| 5,513,722 | A | * | 5/1996 | Foltz | 184/55.2 |
| 5,908,491 | A | * | 6/1999 | Hobbs | 95/202 |

FOREIGN PATENT DOCUMENTS

| | | | | |
|---|---|---|---|---|
| EP | 0 213 031 | | * | 3/1987 |
| GB | 2 279 270 | | * | 4/1995 |
| JP | 55-18256 | | * | 2/1980 |
| JP | 56-165839 | | | 12/1981 |
| JP | 59-179126 | | * | 10/1984 |
| JP | 60-232226 | | * | 11/1985 |
| JP | 05228392 | A | | 9/1993 |
| JP | 406015131 | A | | 1/1994 |
| JP | 06-39229 | | * | 2/1994 ..... 126/299 E |
| JP | 407031823 | A | | 2/1995 |
| JP | 07318131 | A | | 12/1995 |
| JP | 409178237 | A | | 7/1997 |
| JP | 09271622 | | * | 10/1997 |
| JP | 10-216447 | | * | 8/1998 |
| JP | 11002414 | A | | 1/1999 |
| JP | 2000-126533 | | * | 5/2000 |
| JP | 2000-157821 | | * | 6/2000 |

* cited by examiner

SCRUBBER VENTILATION SYSTEM

CROSS-REFERENCE TO RELATED APPLICATION

This application is a continuation-in-part application of a patent application having Ser. No. 09/708,746 and a Filing Date of Nov. 7, 2000, now abandon.

BACKGROUND OF THE INVENTION

1. Field of the Invention

This invention relates to a ventilation system for efficiently removing cooking effluents and combustion products from the exhaust of a cooking appliance.

2. Description of Related Art

Traditionally, restaurant kitchens are ventilated by capturing the cooking effluents and, in the case of gas-fired appliances, combustion products in a hood and transporting the grease-laden exhaust airflow from the inside of the building to the outdoors through welded steel ducts. The grease load in the welded steel ducts is reduced by fitting the hoods with a baffler or slot filters that remove the heavier grease particles by impaction. The smaller, lighter grease particles and grease vapors bypass these filters and deposit on the duct walls and the building creating fire and safety issues.

Traditional kitchen ventilation systems are expensive, in no small part because of the welded steel ductwork, resulting in acceptance of recirculating ventilation technology that does not require the removal of all exhaust airflow from the building. Such recirculating ventilation technology typically includes a hood and a grease filtering element to capture grease from the cooking effluents and combustion products from the gas-fired appliance. An odor removal or control element is also positioned within the hood together with a blower to return the scrubbed air back to the interior of the building. A fire suppression device is also required to control the dangers associated with ignition of grease or other combustion products.

The grease filtering element according to related art devices may comprise an electronic air cleaner such as an electrostatic precipitator (ESP) or HEPA filters. Such electronic air cleaners are often used to filter air drawn into the building and more recently are used to clean grease-laden exhaust airflow prior to recirculation back into the building. These systems must have fire suppression devices because the electronic air cleaners use a high field voltage and may act as an ignition source. Further, grease may collect within the device and may ignite if a fire starts in an appliance positioned beneath the device.

Several existing recirculation ventilation units featuring ESP technology followed by charcoal granular filters are now in use. In such devices, the ESP modules are largely effective only in removing grease particles and droplets with little impact on grease vapor and cooking odors. However, grease vapor may account for approximately 50–60% by weight of the grease emitted during frying and approximately 40% by weight of the grease emitted during charbroiling. Given the apparent lack of effectiveness of the ESP modules in removing grease vapor, the charcoal filters located upstream become coated with grease vapor and are thus only marginally effective with respect to their primary function, odor control. Finally, the ESP modules must be maintained on a regular, often times daily basis to clean grease from internal plates or the performance of the ESP modules quickly drops off.

Therefore, there exists a need for a low cost, low maintenance ventilation system that will effectively remove cooking effluents and combustion products, as well as associated odors, from the exhaust of a cooking appliance.

SUMMARY OF THE INVENTION

It is one object of this invention to provide a ventilation system for efficiently removing cooking effluents from the exhaust gases of a cooking appliance.

It is another object of this invention to provide a ventilation system for efficiently removing cooking effluents and combustion products from the exhaust gases of gas-fired cooking appliances.

It is another object of this invention to provide a method for removing the cooking effluents and combustion products from the exhaust gases of the gas-fired cooking appliance.

It is still another object of this invention to provide a ventilation system and method for efficiently controlling the odor associated with the cooking effluents and combustion products of the gas-fired cooking appliance.

These and other objects of this invention are addressed by a ventilation system comprising a ventilation hood having an air inlet and an exhaust gas outlet, which ventilation hood is disposed over a cooking appliance to capture and direct cooking effluents, including grease particles and grease vapors, into the ventilation system. Combustion products may be captured by the hood and exhausted from the cooking area separately from the cooking effluents. A water bath is disposed in the ventilation hood between the air inlet and the exhaust gas outlet and is in fluid communication with both the air inlet and the exhaust gas outlet. Also disposed within the ventilation hood above and downstream of the water bath is a removal means for removing the cooking effluents from the exhaust gases. As used herein, the terms "upstream" and "downstream" are defined in terms of the direction of flow of the air and exhaust gases through the ventilation system. Thus, the water bath is considered to be downstream of the air inlet and upstream of the exhaust gas outlet. As the airflow moves from the air inlet into the water bath and through the removal means for removing the cooking effluents from the exhaust gases, the airflow is dispersed to form a plurality of air bubbles. The cooking effluents are "captured" by the removal means, resulting in their removal from the exhaust gases. Without wishing to be bound to any single explanation or theory regarding the mechanism of this invention, it is believed that the formation of air bubbles by and within the removal means provides the principle means for removal of the cooking effluents from the exhaust gases. The clean exhaust gases may then be recirculated through the appliance or the building or vented to the atmosphere.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
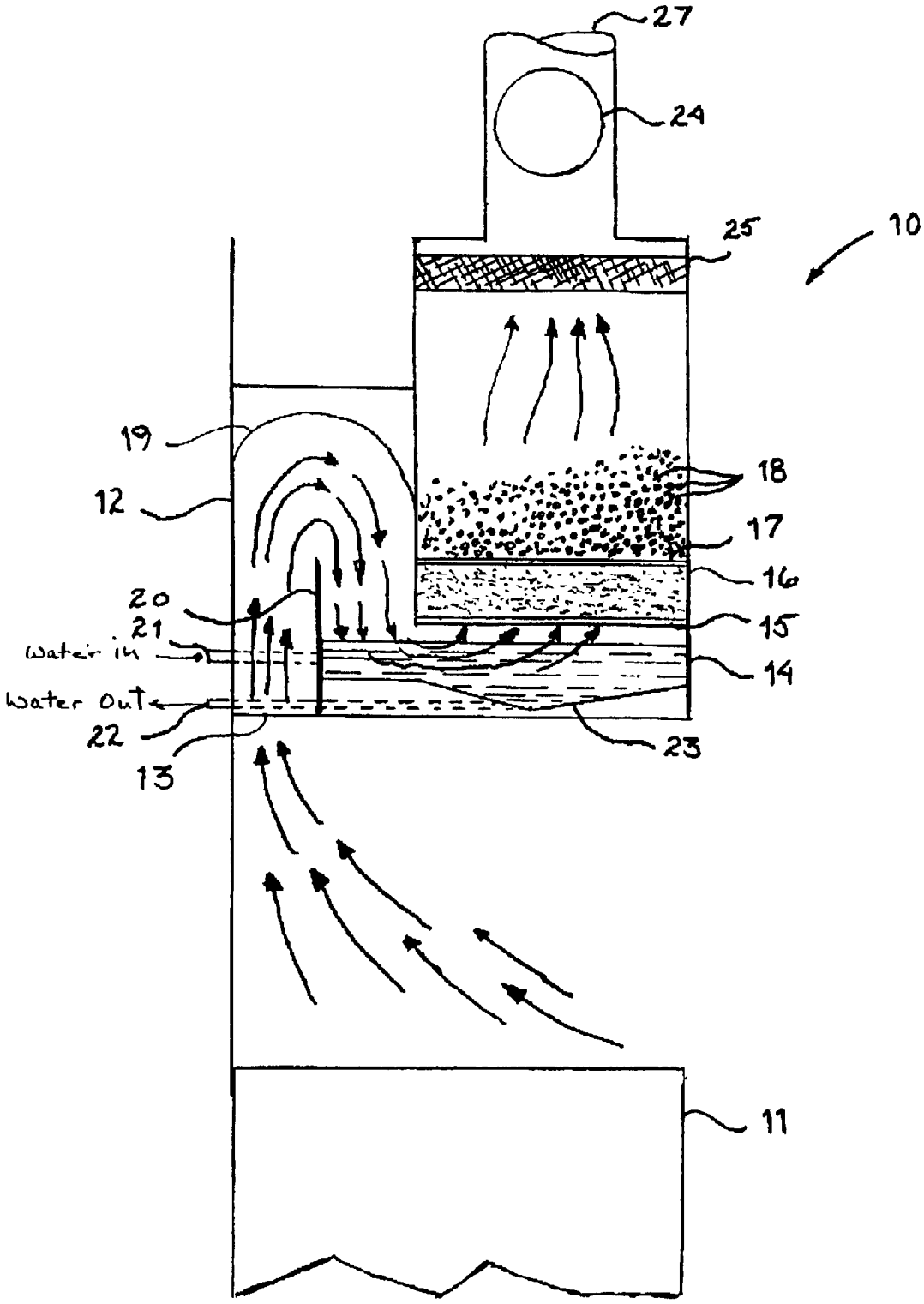
FIG. 1 is a schematic side view of a ventilation system for removing cooking effluents from an exhaust of a cooking appliance in accordance with one preferred embodiment of this invention.

FIG. 1 shows a ventilation system for removing cooking effluents from the exhaust of a cooking appliance in accordance with one embodiment of this invention. As shown, ventilation system 10 comprises a ventilation hood 12 positioned above a cooking appliance 11, for example a deep-fat fryer or a grill. Preferably, but not necessarily, cooking appliance 11 is a gas-fired cooking appliance. Ventilation hood 12 has dimensions suitable for capturing substantially all of the cooking effluents and combustion products from the cooking appliance 11. Ventilation hood 12 may be made of any suitable material, for example sheet metal, capable of withstanding the high temperatures and environments associated with cooking appliance 11. Ventilation hood 12 has an air inlet 13 through which the exhaust gases from the cooking appliance 11, which include air, grease particles and grease vapors, are introduced into ventilation hood 12. Ventilation hood 12 also includes an exhaust gas outlet 27 through which the exhaust gases from the cooking appliance 11, with substantially all of the cooking effluents removed, are exhausted into the atmosphere. Alternatively, the exhaust gases may be recirculated from exhaust gas outlet 22 to the air inlet 13.

Disposed within ventilation hood 12 is a water bath 14, which is in fluid communication with air inlet 13, whereby the exhaust gases from cooking appliance 11 are directed through air inlet 13 and into contact with the water in the water bath 14. In accordance with one preferred embodiment of this invention, the bottom 23 of water bath 14 is V-shaped. The direction of the exhaust gases from cooking appliance 11 into contact with the water in water bath 14, in accordance with one embodiment of this invention, is facilitated by baffle 19 and water bath wall 20 which direct the exhaust as indicated by the arrows.

Figure 2:
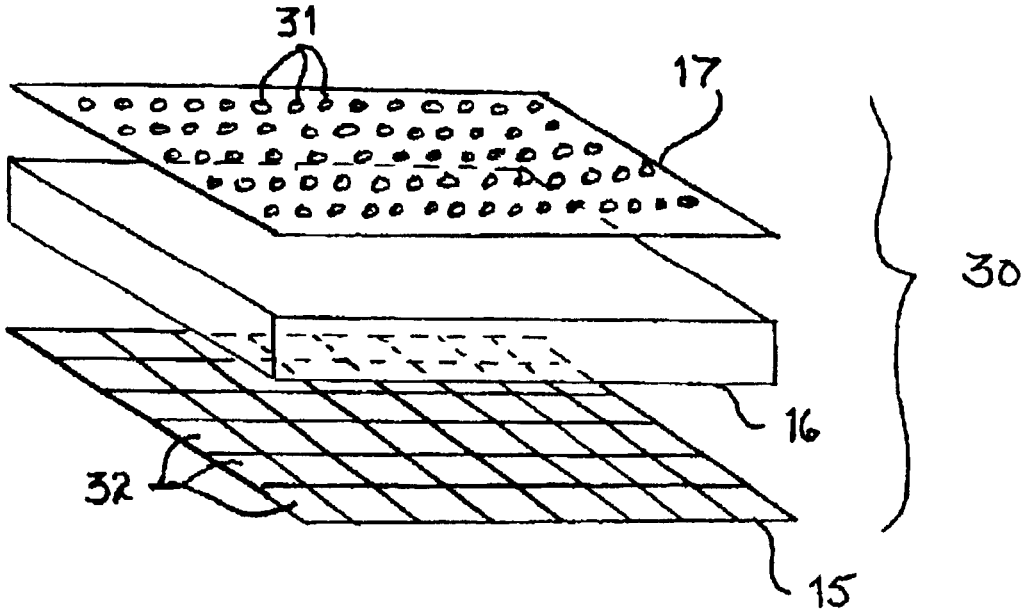
FIG. 2 is an exploded, perspective view of an effluent removal assembly in accordance with one embodiment of this invention.

Disposed above and downstream of water bath 14 is removal means for removing the cooking effluents from the exhaust gases. In accordance with one preferred embodiment of this invention, the removal means comprises an effluent removal assembly 30 as shown in FIG. 2. The effluent removal assembly 30 is disposed above and downstream of water bath 14 and comprises a porous web material 16 disposed between an open support structure 15 and a perforated plate 17. As used in the specification and claims hereof, the term "porous", when used to describe a material, refers to a material having pores through which a gaseous fluid is able to pass. As used in the specification and claims hereof, the term "perforated", when used to describe a material, refers to a material having one or more holes that are formed by perforation means such as a punch or bore or drill. As used in the specification and claims hereof, the term "open support structure" refers to a substantially planar element with openings through which the cooking effluents can pass into the porous web material 16. In accordance with one preferred embodiment of this invention, the open support structure is a perforated plate or foil. In accordance with another preferred embodiment, the open support structure is a wire mesh screen. A suitable porous web material, FM 100 Poly Media, is available from Fiberbond Corporation, Michigan City, Ind. In accordance with one particularly preferred embodiment of this invention, the effluent removal assembly 30 is a planar structure with the wire mesh screen 15 disposed on the face of the porous web material 16 that faces water bath 14.

In accordance with one preferred embodiment of this invention, perforated plate 17 comprises a plurality of perforations or apertures 31. Preferably, but not necessarily, perforations 31 form an open area of about 36% of the surface of the plate and have a generally circular cross-section having a diameter of about 0.109 inches to about 0.142 inches, more preferably about 0.123 inches to about 0.127 inches. Perforations 31 may have any shape and/or dimensions suitable for precluding cooking effluents from blocking or restricting exhaust gas flow therethrough.

In accordance with one preferred embodiment of this invention, porous web material 16 has a thickness in the range of about 2.0 inches to about 4.0 inches, more preferably in the range of about 3.0 inches to about 3.3 inches. It will be apparent to those skilled in the art that this thickness may be achieved by a single layer of porous web material or it may be achieved by the combination of a plurality of individual layers of porous web material. In addition to thickness, porosity of the porous web material is an important element in terms of achieving the desired cooking effluent removal. If the porosity is too low, the amount of exhaust gases laden with cooking effluents that passes through the porous web material will also be low, resulting in a relatively high pressure drop across the porous web material, which, in turn, will require the use of more energy to enable passage of the exhaust gases through the porous web material. On the other hand, if the porosity is too high, the water from water bath 14 will pass through the porous web material without producing the bubbling effect believed to be a contributing factor in the removal of the cooking effluent from the exhaust gases. Preferably, the porous web material 16 has a porosity that corresponds to a pressure drop across the porous web material 16 in the range of about 0.13 inches of water to about 0.15 inches of water at a velocity of about 300 feet per minute.

To provide for the flow of air and exhaust gases into air inlet 13, the removal means further comprises a blower 24 operably connected to ventilation hood 12. In accordance with one preferred embodiment of this invention, blower 24 is disposed downstream of water bath 14. In this embodiment, the air laden with cooking effluents is drawn into ventilation hood 12 through air inlet 13, drawn into contact with water bath 14, drawn through effluent removal assembly 30 and exhausted to the atmosphere through exhaust outlet 27. The suction pressure produced by blower 24 raises the water level within water bath 14 while reducing the water level within the outlet portion of air inlet 13, creating a low pressure drop. We have found that using less than 4 inches of W.C. pressure across blower 24, ventilation system 10 achieves about 80% to about 90% cooking effluent removal.

As shown in FIG. 1, according to one preferred embodiment, a filter bed or HEPA filter 25, for example having a charcoal filter, is disposed in ventilation hood 12 downstream of effluent removal assembly 30 and may be used as a supplemental means for controlling grease and odor. In particular, HEPA filter 25 assists in removing cooking effluents and combustion products from the exhaust.

A key to successful operation of the ventilation system of this invention is the location of the effluent removal assembly 30 with respect to water bath 14. Specifically, successful operation of the ventilation system requires that the effluent removal assembly 30 be disposed sufficiently close to the water bath 14 such that, during operation of the ventilation system, water from water bath 14 together with the cooking effluent laden air, is drawn into the porous web material 16, preferably to a degree such that porous web material 16 becomes substantially saturated with water. In accordance with one embodiment of this invention, a hydrophilic agent is applied to the porous web material to facilitate the introduction of the water from water bed 14 into the porous web material.

In accordance with one embodiment of this invention, a low-foaming surfactant, for example ELECTRASOL, is added to the water in water bath 14. The surfactant helps to solubilize otherwise non-soluble grease compounds and promotes the transfer of these grease compounds to the surrounding water, thus increasing the efficiency of ventilation system 10. Further, the surfactant eliminates or reduces the odors associated with the cooking effluents produced during operation of cooking appliance 11. Although any surfactant is applicable, specific surfactants include any selected from the group comprising ELECTRASOL, potassium permanganate, sodium hydrogen sulfite with sodium bicarbonate, and propylene glycol. Other suitable surfactants or chemical additives may be added to water bath 14 to promote solubilization of grease compounds and to provide an efficient means of odor control.

During operation of ventilation system 10, the amount of water in water bath 14 decreases, thereby reducing the overall efficiency thereof. Accordingly, to enable replenishment of the water from time to time, water bath 14 comprises a water inlet 21, which is connected to a water supply (not shown). Also during operation of ventilation system 10, it may be necessary to remove water for disposal of the effluents collected therein. To enable removal of the water, water bath 14 also comprises a water outlet or drain 22. In accordance with one embodiment of this invention, means are provided for removing the collected cooking effluents from the water and returning the water to water bath 14.

One important factor for efficiently removing the cooking effluents is the contact time between the cooking effluents and the water. In accordance with one embodiment of this invention, the velocity at which the air laden with cooking effluents moves through effluent removal assembly 30, referred to as airflow velocity, is preferably in the range of about 280 ft/min to about 480 ft/min, more preferably in the range of about 350 ft/min to about 375 ft/min in order to optimize the contact time. Other factors believed to affect the efficiency of ventilation system 10 include the surface area of the air bubbles produced by effluent removal assembly 30, the air bubble density (void volume), and the free surface area, i.e. the surface area at a waterline within water bath 14 available for bubbling. For example, in a 450 cfm system, the free surface area is preferably about 135 sq. inches to about 230 sq. inches, more preferably about 170 sq. inches to about 185 sq. inches.

In addition to the efficient removal of cooking effluents from the inlet airflow, ventilation system 10 also effectively reduces the temperature of the airflow, which promotes grease vapor condensation. Ventilation system 10 is an effective evaporative cooling device. In one preferred embodiment of this invention, the airflow temperature decreases as a result of achieving 100% saturation of the effluent removal assembly 30 as the airflow passes through water bath 14, wherein sensible heat is exchanged for latent heat of evaporation. Further, water bath 14 acts as a fire damper by restricting the propagation of a fire into blower 24.

The flow geometry of ventilation system 10, as shown in FIG. 1, permits airflow through water bath 14 without the need of a pump for circulating or managing the water within water bath 14. The airflow passes through water bath 14 with sufficient contact time between cooking effluents and the water for effectively removing cooking effluents from the airflow.

While in the foregoing specification this invention has been described in relation to certain preferred embodiments thereof, and many details have been set forth for purpose of illustration, it will be apparent to those skilled in the art that the system and method according to this invention are susceptible to additional embodiments and that certain of the details described herein can be varied considerably without departing from the basic principles of the invention.

We claim:

1. A ventilation system for removing cooking effluents and combustion products from exhaust gases of a cooking appliance, the ventilation system comprising:

a ventilation hood having an air inlet and an exhaust gas outlet disposed over said cooking appliance;

a water bath disposed in said ventilation hood between said air inlet and said exhaust gas outlet; and effluent removal means for removing said cooking effluents from said waste gases disposed proximate said water bath downstream of said water bath, whereby said effluent removal means are substantially saturated with water during operation of said ventilation system.

2. A ventilation system in accordance with claim 1, wherein said effluent removal means comprises an effluent removal assembly disposed proximate said water bath and positioned to be substantially saturated with said water from said water bath during said operation of said ventilation system, said effluent removal assembly comprising a porous web material disposed between an open support structure and a perforated plate.

3. A ventilation system in accordance with claim 2, wherein said open support structure is selected from the group consisting of a perforated plate, a perforated foil and a wire mesh screen.

4. A ventilation system in accordance with claim 2, wherein said effluent removal assembly is a planar structure with said open support structure disposed on a face of said porous web material facing said water bath.

5. A ventilation system in accordance with claim 2, wherein said effluent removal means further comprises a blower operably connected to said ventilation hood and adapted to direct air through said air inlet to contact said water bath.

6. A ventilation system in accordance with claim 5, wherein said blower is disposed downstream of said water bath.

7. A ventilation system in accordance with claim 2, wherein said porous web material has a thickness in a range of about 2.0 inches to about 4.0 inches.

8. A ventilation system in accordance with claim 2, wherein said perforated plate has an open area in a range of about 25% to about 50% of a total surface area of said perforated plate.

9. A ventilation system in accordance with claim 2, wherein a pressure drop across said porous web material is in a range of about 0.13 inches of water to about 0.15 inches of water at a velocity of about 300 feet per minute.

10. A ventilation system in accordance with claim 2, wherein said perforated plate has a plurality of perforations.

11. A ventilation system in accordance with claim 10, wherein said perforations have a diameter in a range of about 0.109 inches to about 0.142 inches.

12. A ventilation system in accordance with claim 10, wherein said perforations have a diameter in a range of about 0.123 inches to about 0.127 inches.

13. A ventilation system in accordance with claim 1, wherein at least one surfactant is disposed in said water bath.

14. A ventilation system in accordance with claim 13, wherein said at least one surfactant is selected from the group consisting of ELECTRASOL, potassium permanganate, sodium hydrogen sulfite with sodium bicarbonate, propylene glycol and combinations thereof.

15. A ventilation system in accordance with claim 1 further comprising a filter disposed in said ventilation hood downstream of said effluent removal assembly.

16. A ventilation system in accordance with claim 1, wherein a cross-section of a bottom of said water bath in a direction parallel to a direction of flow of air through said ventilation hood is V-shaped.

17. In a ventilation hood positioned over a cooking appliance, a method for removing cooking effluents from an exhaust gas of said cooking appliance comprising the steps of:

directing said exhaust gas into said ventilation hood;

passing said exhaust gas through a water bath disposed in said ventilation hood; and passing said exhaust gas through an effluent removal assembly comprising a porous web material disposed between an open support structure and a perforated plate disposed downstream of and proximate said water bath, substantially saturating said porous web material with water from said water bath and resulting in removal of at least a portion of said cooking effluents from said exhaust gas.

18. A method in accordance with claim 17, wherein said effluent removal assembly is a planar structure with said open support structure disposed on a face of said porous web material facing said water bath.

19. A method in accordance with claim 18, wherein said porous web material has a thickness in a range of about 2.0 inches to about 4.0 inches.

20. A method in accordance with claim 18, wherein a pressure drop across said porous web material is in a range of about 0.13 inches of water to about 0.15 inches of water at a velocity of about 300 feet per minute.

21. A method in accordance with claim 17, wherein said exhaust gas is directed into said ventilation hood by a blower disposed in said ventilation hood downstream of said water bath.

22. A method in accordance with claim 17, wherein said exhaust gas is directed through said effluent removal assembly at a velocity in a range of about 280 ft/min to about 480 ft/min.

23. A method in accordance with claim 17, wherein said exhaust gas is cooled to a temperature sufficient to enable at least a portion of said exhaust to coalesce, forming solid exhaust products.

24. A method in accordance with claim 23, wherein said solid exhaust products comprise grease.

25. A method in accordance with claim 17, wherein said open support structure is selected from the group consisting of a perforated plate, a perforated foil and a wire mesh screen.

26. A ventilation system for removing cooking effluents and combustion products from exhaust gases of a cooking appliance, the ventilation system comprising:

a ventilation hood having an air inlet and an exhaust gas outlet disposed over said cooking appliance;

a water bath disposed in said ventilation hood between said air inlet and said exhaust gas outlet; and effluent removal means for removing said cooking effluents from said waste gases disposed proximate said water bath downstream of said water bath, whereby said effluent removal means are substantially entirely saturated with water during operation of said ventilation system.

* * * * *